US008545044B2

(12) United States Patent
Opolka

(10) Patent No.: US 8,545,044 B2
(45) Date of Patent: Oct. 1, 2013

(54) FLASHLIGHT WITH END-CAP SWITCH

(75) Inventor: Rainer Opolka, Solingen (DE)

(73) Assignee: Zweibrueder Optoelectronics GmbH & Co. KG, Solingen (DE)

( * ) Notice: Subject to any disclaimer, the term of this patent is extended or adjusted under 35 U.S.C. 154(b) by 151 days.

(21) Appl. No.: 13/132,927

(22) PCT Filed: Nov. 19, 2010

(86) PCT No.: PCT/DE2010/001345

§ 371 (c)(1),
(2), (4) Date: Jun. 16, 2011

(87) PCT Pub. No.: WO2011/060765

PCT Pub. Date: May 26, 2011

(65) Prior Publication Data

US 2011/0235316 A1 Sep. 29, 2011

(30) Foreign Application Priority Data

Nov. 20, 2009 (DE) ..... 10 2009 054 119

(51) Int. Cl.
*F21L 4/04* (2006.01)
*F21L 4/00* (2006.01)
*F21V 23/04* (2006.01)

(52) U.S. Cl.
USPC ..... 362/206; 362/205; 362/208; 200/60

(58) Field of Classification Search
USPC ..... 362/205, 206, 208; 200/456, 532, 200/535, 546, 559, 569, 283, 60
See application file for complete search history.

(56) References Cited

U.S. PATENT DOCUMENTS

| | | | | |
|---|---|---|---|---|
| 1,855,015 | A * | 4/1932 | Fraser et al. | 362/206 |
| 1,977,086 | A * | 10/1934 | Pryor | 362/208 |
| 4,733,337 | A * | 3/1988 | Bieberstein | 362/206 |
| 5,304,753 | A * | 4/1994 | Parrish et al. | 200/16 B |
| 5,345,051 | A * | 9/1994 | Miike | 200/345 |
| 6,092,910 | A * | 7/2000 | Sung | 362/206 |
| 6,107,586 | A * | 8/2000 | Takeuchi et al. | 200/535 |
| 6,536,912 | B2 * | 3/2003 | Parker | 362/206 |
| 6,742,911 | B1 * | 6/2004 | Chen | 362/206 |

* cited by examiner

*Primary Examiner* — Jong-Suk (James) Lee
*Assistant Examiner* — Alexander Garlen
(74) *Attorney, Agent, or Firm* — Andrew Wilford

(57) ABSTRACT

The present invention relates to a flashlight with a flashlight casing and a push switch, latching switch or rotary switch contained in an end cap having a switch housing in which a first and a second contact engage. According to the invention, the first contact is a leaf spring engaging in direct electrical connection directly against the electrically conductive flashlight casing or directly against the electrically conductive end cap that is also detachably connected to the flashlight casing, the second contact being a bent leaf spring outside the switch housing directly connected to a power supply.

20 Claims, 3 Drawing Sheets

Fig. 1a
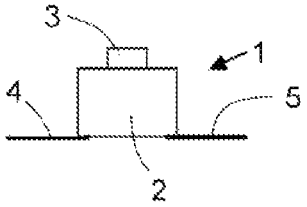
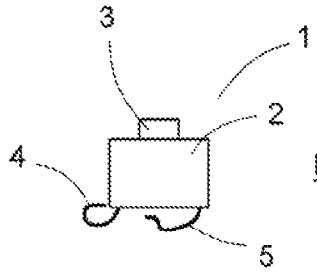
Fig. 1b
Fig. 1c
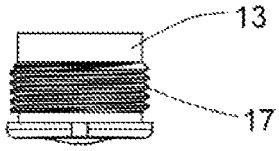
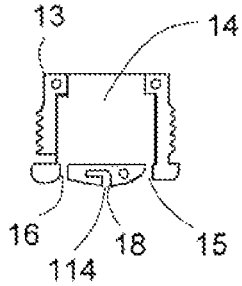
Fig. 1d
Fig. 1e
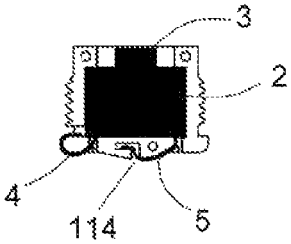
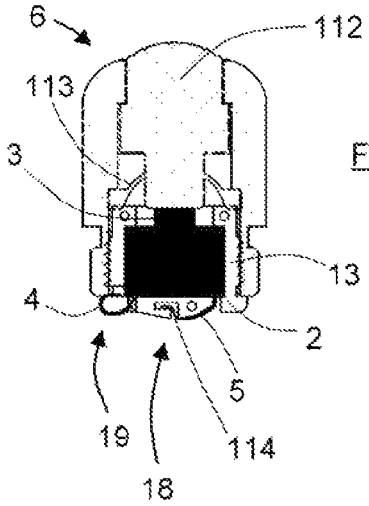
Fig. 1f
Fig. 1g
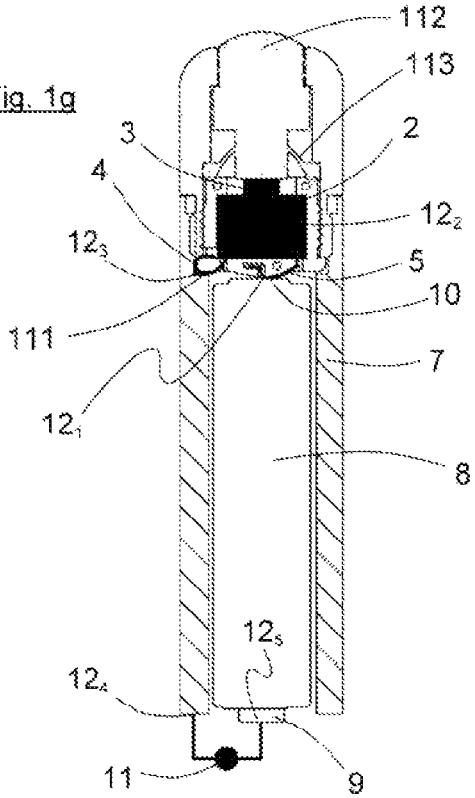

FLASHLIGHT WITH END-CAP SWITCH

CROSS REFERENCE TO RELATED APPLICATIONS

This application is the US-national stage of PCT application PCT/DE2010/001345, filed 19 Nov. 2010 and claiming the priority of German patent application 102009054119.5 itself filed 20 Nov. 2009.

FIELD OF THE INVENTION

The present invention relates to a flashlight with a flashlight casing and a push switch, latching switch or rotary switch mounted in an end cap having a switch housing in which a first and a second contact engage.

BACKGROUND OF THE INVENTION

It is known to integrate a switch in the end cap that is screwed onto the flashlight casing, the battery (batteries) or the storage batteries being inserted into the flashlight casing with the end cap unscrewed. With flashlights of this type one contact of the switch is connected to a spiral spring that on the one hand fixes the batteries inside the flashlight and on the other hand forms a connection with one pole of the battery, so that the current flows via the spiral spring. In order to create a closed electric circuit in the switched-off state, usually the other contact is positioned by the end cap so that the electric current flows from there further via the thread or other electrical connections over the flashlight casing to the light source.

The disadvantage of circuits in conventional flashlights is on the one hand that the current is guided through a plurality of connections such that a specific contact resistance is effective at each connection. Furthermore, due to the current flow inside the spiral current a self-induction voltage is induced that counteracts the actual current flow. Both of these lead to a lower voltage being available for the light source, so light output of the light source is markedly reduced.

OBJECT OF THE INVENTION

It is therefore the object of the present invention to create a flashlight with a switch in which the number of contacts is reduced and current flow is optimized, in particular current flow via a spiral spring is avoided.

SUMMARY OF THE INVENTION

This object is attained by the flashlight according to the invention in which, according to the invention, the first contact is a leaf spring engaging in direct electrical connection against the electrically conductive flashlight casing or directly against the electrically conductive end cap, which is also detachably connected to the flashlight casing, the second contact being formed as a bent leaf spring outside the switch housing and directly connected to a power supply. A plurality of electrical connections is hereby avoided. In particular, connection from a contact and through the contact spring is eliminated. Furthermore, the current is no longer guided via the spiral spring, so that no power is lost due to the relatively high self-inductance of a spiral spring. Advantageously, less power is lost through the circuit according to the invention, so that it is available for the light source.

In particular according to a preferred embodiment a light-emitting diode (LED) is provided as light source and at least one battery or a storage battery, i.e. at least one rechargeable battery, is provided as the power supply. Likewise, as is known according to the prior art, a stack of several batteries connected in series can also be used. Above all the use of an LED as a light source reduces the power consumption so that more energy is used to generate light.

According to a further development of the invention, the switch is contained in a subhousing having apertures through which the contacts of the switch project outward radially or at its front end where they are formed as leaf springs and form current-conducting electrical connections. The subhousing is preferably formed from plastic by injection molding so that production costs can be kept extremely low. The subhousing preferably has two parts and is preferably composed of two semicylindrical tube segments. In order to insert a switch into the subhousing, first the tube segments are separated from one another and the switch is placed inside one of the tube segments. Subsequently, the tube segments are joined again to form the subhousing, and the switch is contained and held inside the subhousing. So that the contacts of the switch can be guided out of the subhousing in order to render possible an electric contact, according to a preferred embodiment of the invention at least one of the connection surfaces of the tube segments is formed with grooves in which the contacts lie with the switch in place. Preferred positions of the cited grooves are explained in more detail below.

The subhousing preferably has a further hole through which in the assembled state a control button engages, with which the switch is actuated. The control button is a part of the end cap in which the control button is coaxially shiftable. Preferably, a flexible rubber seal is provided between the control button and the switch so that the switch and the contacts are supported in a dust-tight and moisture-tight manner.

As already indicated, according to a particularly preferred embodiment of the present invention, the subhousing is detachably fastened inside the end cap, to which end the subhousing preferably has an external thread and the end cap preferably has a complementary internal thread so that the subhousing can be screwed into the end cap. Alternatively, the subhousing could also be connected to the end cap by a plug connection, a latching connection or a bayonet connection. A stable option that is easy to assemble is hereby created for securely supporting the switch inside the end cap. One notable feature that results is the low number of parts used, since, in addition to the end cap, the two-part subhousing and the switch, no further parts have to be used in order to make up an operational end cap switch. This results in a reduction in the assembly as well as material costs.

In order to ensure a secure, trouble-free and current-conducting connection, the contacts, which project out of the subhousing as leaf springs, must be connected to current-conducting parts of the flashlight. In principle, two different options are provided for this purpose, which essentially differ through the embodiment of the first contact, without the present invention being restricted thereto.

In both embodiments the second contact engages through an aperture of the subhousing and forms on the front face thereof an electrical connection with a pole of the battery or the storage battery in the assembled state. On the one hand, this avoids the current flowing via a spiral spring, on the other hand, the contact is a bent leaf spring that can bear firmly on the pole to form a good connection therewith. To hold the second contact in a stable manner, the free end thereof is preferably fitted in an L-shaped aperture on the front face of the subhousing. Alternatively to this, the leaf spring can also be fixed via a small screw or other fastener.

According to a first preferred embodiment of the first contact, it extends through an aperture in the subhousing and in the assembled state forms an electrical connection with the flashlight casing. To this end, the aperture is on the front face of the subhousing and is a bent leaf spring that engages through the aperture and has a projecting part at least partially engaging around the cylindrical wall of the subhousing on the front, so that there is an electrical connection with the flashlight casing that to this end preferably has a socket-shaped projection as a mounting surface and electric contact surface. Because the end cap can be screwed onto the flashlight casing, the pressure with which the first contact is pushed onto the socket-shaped projection can be selected as desired so that an extremely strong and secure contact is created there. Furthermore, with this embodiment the advantage results that the current is not guided via the end cap but directly onto the flashlight casing, so that a connection interface, namely from the end cap to the flashlight casing, is eliminated compared to conventional flashlights.

According to an alternative embodiment, the first contact engages through an aperture in the subhousing and in the assembled state forms an electrical connection with the end cap. To this end, the aperture is on the outer surface of the subhousing and engages through this aperture and the end of the contact projecting out of the aperture lies on an annular shoulder face that projects at least in some regions radially from the wall surface of the subhousing so that in the assembled state there is an electrical connection with the end cap in which the subhousing is detachably fixed. The bearing surface can here be an annular extension of the front face of the subhousing. In other words, the first contact is clamped between a bearing surface of the subhousing and the end cap, so that when the subhousing is screwed into the end cap a secure connection is created by high pressure. Although with this embodiment the current is guided via the end cap, so that further connection interface is formed between the end cap and the flashlight casing, the first contact with this embodiment is supported more securely free from dust and dirt, so that a battery change above all in a dusty and dirty environment is associated with a low risk of soiling the contact surface, and the electric contact could be impaired under some circumstances.

The switch has a simple plastic housing from which, in addition to the contacts, an actuating element also projects. According to a preferred embodiment, the actuating element is axially moveable and/or has an electrically conductive contact plate on its front and engageable with both contacts at the same time. A simple option is created hereby for forming a press switch with as few contacts as possible.

Alternatively to this, one of the contact can be formed inside the housing as a bent leaf spring that in the relaxed state is spaced from the other contact, and both contacts can be connected by movement the actuating element against the force of the leaf spring. Through this measure a further contact interface is eliminated compared to the alternatives with a contact plate. In both alternative embodiments, however, in an advantageous manner that the actuating element is a push button or a rotary knob that is axially moveable against the force of a spiral spring. The actuating element in the relaxed state is spaced from the contacts so that an accidental switching on or off of the flashlight is prevented.

Finally, according to a further advantageous embodiment of the invention, snap-in elements are provided on the actuating element, so that a touch function or optionally a permanent switch function is adjustable. This means that not only the handling of the flashlight but also the functionality is improved.

BRIEF DESCRIPTION OF THE DRAWING

Concrete embodiments as well as further advantageous embodiments of the present invention are described below with reference to the drawings. Therein:

FIGS. 1*a-g* show individual parts of a flashlight separately and when assembled.

DETAILED DESCRIPTION OF THE INVENTION

Figure 2A:
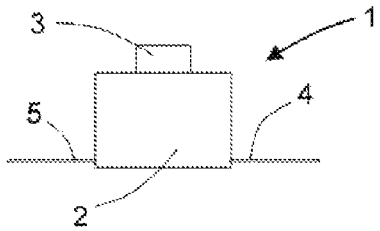
FIGS. 2*a-g* show alternative embodiments of the individual parts, FIGS. 3*a* and 3*b* each show a respective embodiment of a switch.
Figure 2B:
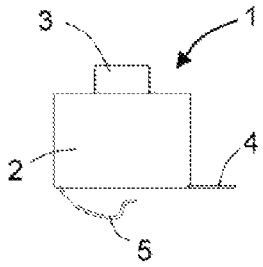
Figure 2C:
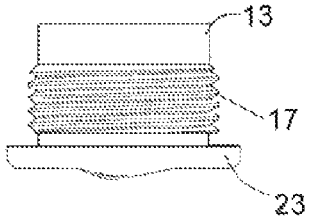
Figure 2D:
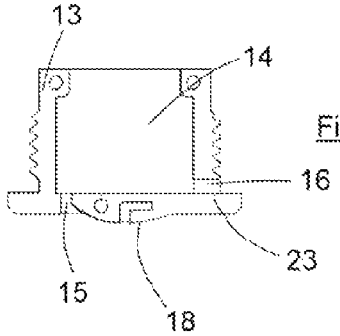
Figure 2E:
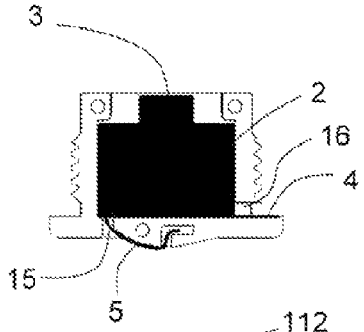
Figure 2F:
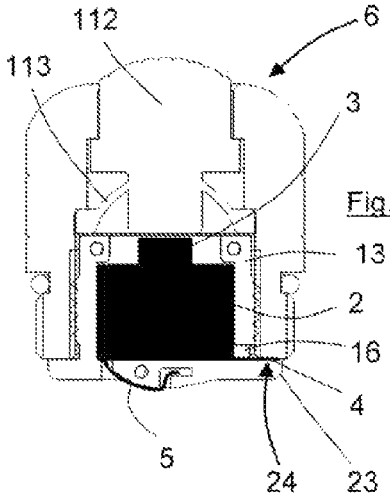
Figure 2G:
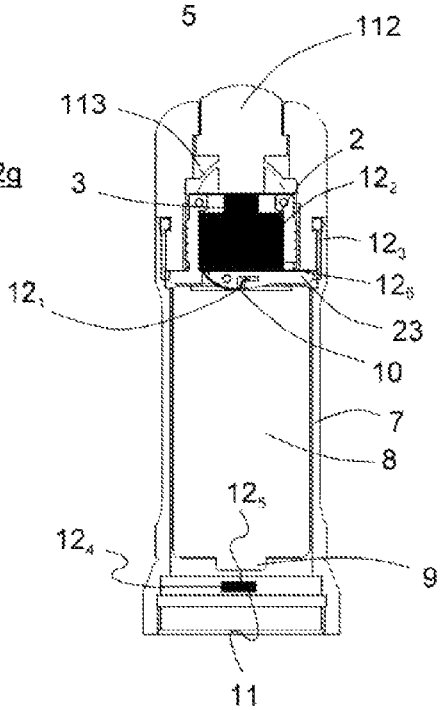

A switch 1, as preferably used in the circuit according to the invention or in the flashlight according to the invention, has a housing 2 as well as an axially displaceable actuating element 3 formed as a latch or push button. Furthermore, a first contact 4 as well as a second contact 5 are provided that both can be bent leaf springs (see FIG. 1*b*). In a switch 1 of this type, the contacts 4 and 5 project out of the housing 2 into an end cap 6 (see FIG. 1*f*) that can be screwed onto the rear end of a flashlight casing 7 (FIG. 1*g*). A battery 8 with poles 9 and 10 is inside the flashlight casing 7 with the pole 10 connected to the second contact 5. In order to be able to safely support the switch inside the end cap 6, according to one embodiment it is held in a subhousing 13 that has two parts. FIG. 1*c* shows a side view of the subhousing 13, while FIG. 1*d* is a section through the subhousing 13. The switch 1 with bent contacts 4 and 5 is held inside a cavity 14 of a part of the subhousing 13. The outer surface of the subhousing 13 is formed with groove-shaped apertures 15 and 16 in which the contacts 4 and 5 fit (FIG. 1*e*, FIG. 2*e*). Subsequently, the two half-shell parts of the subhousing 13 are joined, so that the switch 1 is contained securely between them. The subhousing 13 has an external screwthread 17 so that it can be screwed with the installed switch 1 into the end cap 6 (FIG. 1*f*, FIG. 2*f*). This end cap 6 in turn is connected to the flashlight casing 7 to form the finished flashlight (FIG. 1*g*, FIG. 2*g*).

As already explained above, essentially two options are provided for closing the connection between the first contact 4 and the flashlight casing 7 that are shown in particular in FIG. 1*f*, FIG. 1*g* and FIG. 2*f*. In the embodiment according to FIG. 1*f*, the aperture 16 for the first contact 4 is on a front face 18 of the subhousing 13. The free end of the contact 4 engages partly around the wall of the subhousing 13 (see arrow 19). When assembled (FIG. 1*g*), the contact 4 is pressed onto a seat 111 inside the flashlight casing 7 to form an electrical connection.

In the alternative embodiment (FIG. 2*f*), the aperture 16 for the first contact 4 is in the wall of the subhousing 13, and thereafter engages a surface 23. When the subhousing 13 is placed into the end cap 6, the first contact 4 is clamped between the end cap 6 and the surface 23, and an electrical is formed at 24.

In order to protect the interior of the flashlight as well as the circuit from the entry of dirt and moisture, a rubber seal ring 113 is provided between the subhousing 13 and a control button 112.

The circuit is formed by the battery 8, the switch 1 with the contacts 4 and 5, the flashlight casing 7 and a light source 11. If only one contact is available inside the switch, only five contact connections $\mathbf{12}_1$, $\mathbf{12}_2$, $\mathbf{12}_3$, $\mathbf{12}_4$, and $\mathbf{12}_5$ are provided in the circuit according to FIG. 1*g*. In an embodiment according to FIG. 2*g* one contact connection $\mathbf{12}_6$ is added.

Figure 3A:
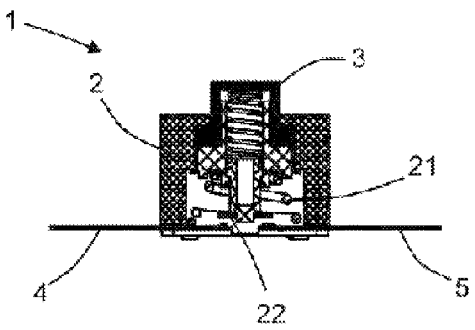
Figure 3B:
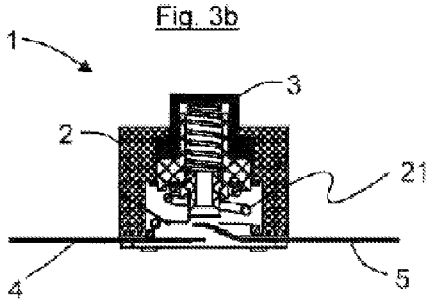
Figure 4A:
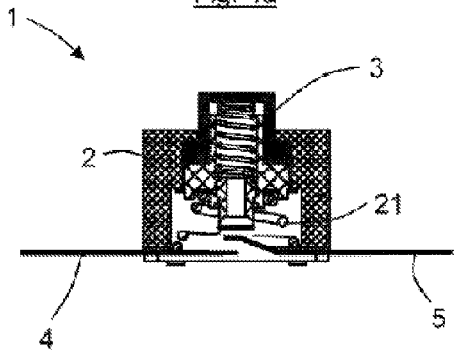
FIGS. 4*a* and 4*b* show the operation of a switch.
Figure 4B:
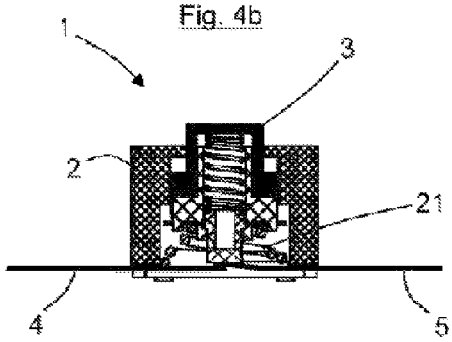

FIGS. 3*a* and *b* each show an embodiment of the switch 1, as it is preferably used in the circuit according to the invention. The actuating element 3 is axially moveable and is held at a spacing from the contacts 4 and 5 by the force of a spiral spring 21. The actuating element 3 according to FIG. 3*a* has on its front end a contact plate 22 that on actuation of the actuating element 3 is pressed onto the contacts 4 and 5 so that the electric circuit is closed. In the other embodiment, the second contact 5 is a leaf spring inside the housing 2, and the contacts 4 and 5 can be brought into mutual contact by the actuating element 3. For the embodiment in which the second contact 5 inside the housing is a leaf spring, in FIGS. 4*a* and *b* the actuating operation is shown diagrammatically.

The invention claimed is:

1. A flashlight comprising:

an electrically conductive flashlight casing;

an end cap detachably connected to the casing;

a push, latching or rotary switch having a housing contained in the end cap;

first and second contacts each at least partially mounted inside the switch housing, the first contact being a leaf spring in direct electrically conductive contact outside the switch housing with the electrically conductive flashlight casing, the second contact being a bent leaf spring outside the switch housing; and a power supply directly bearing against the bent leaf spring.

2. The flashlight according to claim 1, further comprising:

a light-emitting diode as light source, the power supply being and at least one battery.

3. The flashlight according to claim 1, wherein the switch further has a subhousing having respective first and second apertures through which the first and second contacts of the switch project outward radially or axially forwardly as leaf springs and form current-conducting electrical connections.

4. The flashlight according to claim 3, wherein the subhousing is composed of two semicylindrical tube segments.

5. The flashlight according to claim 4, wherein the tube segments are joined at connection surfaces of which at least one is formed with a groove in which one of the contacts lies with the switch in place.

6. The flashlight according to claim 3, further comprising:

a control button, the subhousing having a hole through which in the assembled state the control button engages for actuating the switch and a flexible rubber seal between the control button and the switch.

7. The flashlight according to claim 3, wherein the subhousing the subhousing has an external thread and the end cap preferably has a complementary internal thread so that the subhousing can be screwed into the end cap for detachably securing the subhousing inside the end cap.

8. The flashlight according to claim 3, wherein the second contact engages through the respective second aperture of the subhousing and forms on a front face thereof an electrical connection with a pole of the battery in the assembled state.

9. The flashlight according to claim 3, wherein a free end of the second contact fits in an L-shaped groove on a front face of the subhousing.

10. The flashlight according to claim 3, wherein the second aperture is on a front face of the subhousing, the first contact being a bent leaf spring and engaging through the respective first aperture and having a projecting part at least partially engaging around a cylindrical outer surface of the subhousing on its front end so that there is an electrical connection with a socket-shaped projection of the flashlight casing.

11. The flashlight according to claim 1 wherein the switch has inside the switch housing an axially moveable actuating element or an electrically conductive contact plate on its front end that can be connected to both contacts at the same time.

12. The flashlight according to claim 11, wherein a each contact is formed inside the switch housing as a bent leaf spring that in the relaxed state is spaced from the other contact, both contacts being engageable together by the actuating element against the pressure of the leaf springs inside the switch housing.

13. The flashlight according to claim 11, wherein the actuating element is a push button or a rotary knob that is axially moveable against the force of a spiral spring.

14. The flashlight according to claim 11, wherein the actuating element has snap-in elements so that a touch function or a permanent switch function is adjustable.

15. A flashlight comprising:

a hollow electrically conductive casing extending along an axis and having a front end and a rear end;

at least one battery in the casing having front and rear poles;

a light source at the front end of the housing connected electrically between the front pole of the battery and the casing;

an end cap releasably secured to the rear end of the to casing;

a first elastically flexible leaf-spring strip contact having an inner end inside the end cap and an outer end projecting therefrom;

a first formation on the end cap pressing the outer end of the first contact, the first contact in direct electrically conductive contact with the casing;

a second elastically flexible leaf spring strip contact is having an inner end inside the end cap and an outer end projecting from the end cap and in direct electrically conductive contact with the rear pole of the battery; and an actuating element carried on the rear end shiftable from outside the casing and outside the end cap between an actuated position electrically interconnecting the inner ends of the contacts and an unactuated position with the inner ends of the contacts out of electrical connection with each other.

16. The flashlight defined in claim 15, further comprising:

a switch subhousing inside the end cap, carrying the actuating element, containing the inner ends of the contacts, and formed with first and second holes through which the respective contacts extend.

17. The flashlight defined in claim 16 wherein the subhousing has an inner end formed with a groove forming the second formation and in which the outer end of the second contact is seated.

18. A flashlight comprising:

a hollow electrically conductive casing extending along an axis, having a front end and a rear end, and formed at the rear end with a seat;

at least one battery in the casing having front and rear poles;

a light source at the front end of the housing connected electrically between the front pole of the battery and the casing;

an end cap releasably secured to the rear end of the to casing;

a first elastically flexible leaf-spring strip contact having an inner end inside the end cap and an outer end projecting therefrom;

a first formation on the end cap pressing the outer end of the first contact, the first contact in direct electrically conductive contact with the seat of the casing;

a second elastically flexible leaf spring strip contact having an inner end inside the end cap and an outer end projecting from the end cap and in direct electrically conductive contact with the rear pole of the battery;

a switch in the end cap capable of bridging the inner ends of the first and second strip contacts and thereby closing an electrical circuit through the casing to the light source from the rear pole of the battery.

19. The flashlight defined in claim 18, wherein the seat is directed axially rearward.

20. The flashlight defined in claim 18, further comprising screwthreads between the end cap and the casing for securing the end cap in place on the casing and form when tightened, pressing the first contact axially forward against the seat.

* * * * *